United States Patent [19]

Rawicz-Szczerbo et al.

[11] Patent Number: 4,754,862

[45] Date of Patent: Jul. 5, 1988

[54] METALLIC ARTICLE DISCRIMINATOR

[75] Inventors: Adam Rawicz-Szczerbo; Les Hutton, both of Oldham, England

[73] Assignee: Coin Controls Limited, Lancashire, England

[21] Appl. No.: 812,817

[22] Filed: Dec. 23, 1985

[30] Foreign Application Priority Data

Jan. 4, 1985 [GB] United Kingdom ..... 8500220

[51] Int. Cl.[4] ..... G07D 5/08; G07F 3/02

[52] U.S. Cl. ..... 194/319; 194/317; 331/1 R

[58] Field of Search ..... 194/303, 317, 318, 319, 194/320; 331/1 R, DIG. 2; 133/3 R; 73/163; 453/3

[56] References Cited

U.S. PATENT DOCUMENTS

| | | | |
|---|---|---|---|
| 2,757,340 | 7/1956 | Cauchois | 331/1 R |
| 3,010,073 | 11/1961 | Melas | 331/1 R |
| 3,373,374 | 3/1968 | Marosi | 331/1 R |
| 3,375,493 | 3/1968 | Gottlieb | 331/1 R |
| 3,506,103 | 4/1970 | Kückens et al. . | |
| 3,870,137 | 3/1975 | Fougere | 194/317 |
| 3,966,034 | 6/1976 | Heiman et al. | 194/318 |
| 4,105,105 | 8/1978 | Braum | 194/319 |
| 4,108,296 | 8/1978 | Hayashi et al. | 194/318 |
| 4,128,158 | 12/1978 | Dautremant, Jr. . | |
| 4,206,775 | 6/1980 | Tanaka | 194/319 X |
| 4,234,071 | 11/1980 | Le-Hong | 194/317 |
| 4,286,704 | 9/1981 | Wood | 194/318 |
| 4,353,452 | 10/1982 | Shah et al. | 73/163 X |
| 4,353,453 | 10/1982 | Partin et al. | 194/319 |
| 4,361,218 | 11/1982 | Van Dort | 194/312 |
| 4,385,684 | 5/1983 | Sugimoto et al. | 194/318 |
| 4,439,734 | 3/1984 | Weber | 331/1 R |
| 4,460,080 | 7/1984 | Howard | 194/317 |
| 4,488,116 | 12/1984 | Plesko | 194/319 X |
| 4,493,411 | 1/1985 | Heiman | 194/318 |
| 4,509,633 | 4/1985 | Chow | 73/163 |
| 4,513,762 | 4/1985 | Yokomori et al. | 133/3 R |
| 4,572,349 | 2/1986 | Furuya et al. | 194/318 |

FOREIGN PATENT DOCUMENTS

| | | | |
|---|---|---|---|
| 0016696 | 10/1980 | European Pat. Off. . | |
| 2510661 | 9/1976 | Fed. Rep. of Germany | 194/319 |
| 2511761 | 9/1976 | Fed. Rep. of Germany | 194/319 |
| 2916123 | 10/1980 | Fed. Rep. of Germany | 194/319 |
| 8404617 | 11/1984 | PCT Int'l Appl. . | |
| 913316 | 12/1962 | United Kingdom . | |
| 1476617 | 6/1977 | United Kingdom . | |
| 1559577 | 1/1980 | United Kingdom . | |
| 2106683 | 4/1983 | United Kingdom | 194/318 |

OTHER PUBLICATIONS

Coin Controls Catalogue, 17 pages, 1985.

*Primary Examiner*—Robert J. Spar
*Assistant Examiner*—P. McCoy Smith
*Attorney, Agent, or Firm*—Morgan & Finnegan

[57] ABSTRACT

A multicoin tester has a coin inlet path 1 along which coins under test run edgewise past coils 2, 3 on opposite sides of the path, and through the windings of a coil 4. Electronic circuitry responsive to the inductive coupling of the coin with the coils operates a gate 5 to either reject the coin onto path 1*b* or to accept the coin into path 1*a.* As shown in FIG. 2 each of the coils 2, 3 and 4 is arranged in a parallel L-C resonant circuit 10, 11, 12 connected in the feedback path of an amplifier A1, the resonant circuit being energised sequentially by multiplexer M1. Each of the circuits 10, 11 and 12 has its own natural resonant frequency. The resonant circuits 10, 11, 12 are driven by a voltage controlled oscillator VCO. A phase locked loop including a phase comparator PS1 drives the oscillator VCO at a frequency corresponding to the natural resonant frequency of whichever of the circuits 10, 11 and 12 is connected thereto. As a coin passes say the coil 2, the resonant frequency of circuit 10 is modified by the coin and the phase locked loop changes the frequency of the VCO to maintain resonance. The resulting output at 15 varies both in amplitude and frequency. The amplitude deviation is digitized by an analogue to digital coverter ADC and compared by a microprocessor MPU with stored values in an EEPROM to determine coin acceptability and denomination; so as to operate gate 5 and provide other optional outputs.

12 Claims, 2 Drawing Sheets

METALLIC ARTICLE DISCRIMINATOR

FIELD OF THE INVENTION

This invention relates to coin discrimination apparatus and has particular but not exclusive application to a multi-coin tester.

BACKGROUND TO THE INVENTION

In the prior art, for example the Model EM5 Electronic Multi-coin Acceptor manufactured by Coin Controls Limited, of Oldham, Lancashire, discrimination between different denominations of coin is achieved by means of an inductive test. Coins under test pass along a predetermined path between pairs of sensor coils. Each pair of sensor coils is connected in its own oscillator circuit. As the coin passes between the coil pairs, the magnitude of the oscillations in the coils is affected in dependence upon the size and metallic characteristics of the coin.

The present invention seeks to improve upon this prior arrangement.

SUMMARY OF THE INVENTION

In accordance with the present invention there is provided coin discrimination apparatus comprising means defining a path for passage of coins under test, sensor coil means for forming an inductive coupling with coins under test during their passage along the path, said sensor coil means being connected in a resonant circuit, oscillator means for energising the resonant circuit, control means for controlling the frequency of oscillation of the oscillator means in such a manner that the resonant circuit is maintained in resonance whilst a coin under test is inductively coupled thereto, and amplitude response means responsive to changes in amplitude of an oscillatory signal developed by the resonant circuit when the coil under test passes the sensor coil means and is inductively coupled thereto.

The impedance of the sensor coil means consists of a "real" (resistive) and "imaginary" (inductive) component. Other prior art devices have concentrated on measurement of the inductive component. However, in accordance with the present invention, the amplitude change of the oscillatory signal provides a means to monitor the resistive component. In accordance with the invention it has been appreciated that this resistive component varies, as a coin passes the sensor coil means, by approximately twice as much as the inductive component. Thus by means of the present invention it is possible to maximise information obtained from the coil, resulting in improved discrimination between coins and against noise.

In accordance with the invention, the sensor coil means may be connected in a parallel capacitance/inductance resonant circuit. At the resonant frequency, such parallel resonant circuits have the property of a purely resistive, very high electrical impedance, the magnitude of which is strongly influenced by the resistive component of the sensor coil impedance. As the coin passes the sensor coil means, the apparatus is so arranged that the resonant circuit is maintained in resonance by changing the frequency of the oscillator means. This is preferably but not necessarily achieved by means of a phase locked loop. The amplitude of the oscillation developed across the resonant circuit thus changes as the coin passes the sensor coil. This signal is preferably demodulated and digitised in order to provide signals which may be further processed to determine the denomination and authenticity of the sensed coin.

The digitised signals may be compared with stored predetermined values representative of true coins of different denominations. These predetermined vlues may be stored in a programmable memory. The programmable memory may comprise an electronically erasable programmable read only memory hereinafter referred to as an EEPROM. The EEPROM may be programmed under the control of an external programming unit which may be connected selectively to the circuit, or may be preprogrammed in the factory.

Preferably, the sensor coil means includes a plurality of sensor coils for forming an inductive coupling with coins travelling along the path, wherein a first of said coils is disposed to one side of the path, a second of the said coils is disposed to another side of the path and the third of the said coils is so arranged that the path passes through the windings thereof.

Preferably, but not necessarily, the diameter of the first coil is greater than the largest coin to be tested by the apparatus.

The preferred coil arrangement used in the present invention permits an improved discrimination between coins of different diameter and different metallic content.

As is explained in more detail in relation to the embodiment hereafter, the magnetic fields due to the third coil may be arranged orthogonal to the field of the first two coils and thereby measurements of the interaction of the coin and the magnetic field due to the coils are influenced by different characteristics of the coin. In addition, for the third coil, the response of the device has a complex dependency on the frequency of oscillation of the coil. With the first two coils, however the coins show a simple trend of improving coin discrimination with frequency. Thus, the coil arrangement provided in the present invention extracts information about the coin under test which is a function both of the mechanical geometry of the coin and the coils, and of the field frequency.

BRIEF DESCRIPTION OF THE DRAWINGS

In order that the invention may be more fully understood an embodiment thereof will now be described in detail with reference to the accompanying drawings wherein:

Referring to FIG. 1, the apparatus consists of a coin path 1 along which the coins under test roll edge-wise past first second and third sensor coils 2, 3, 4. The coils are connected to discrimination circuitry which is shown in more detail in FIG. 2. Broadly stated, if the coin detected by the sensor coils is identified as a true coin, a solenoid operated accept gate 5 (FIG. 1) is opened to allow the coin to pass along path 1*a* down an accept chute 6. If the coin is identified by the circuitry to have non-acceptable characteristics, e.g. a counterfeit coin, the gate 5 is not opened and the coin passes along path 1*b* to a reject chute 7.

Figure 1:
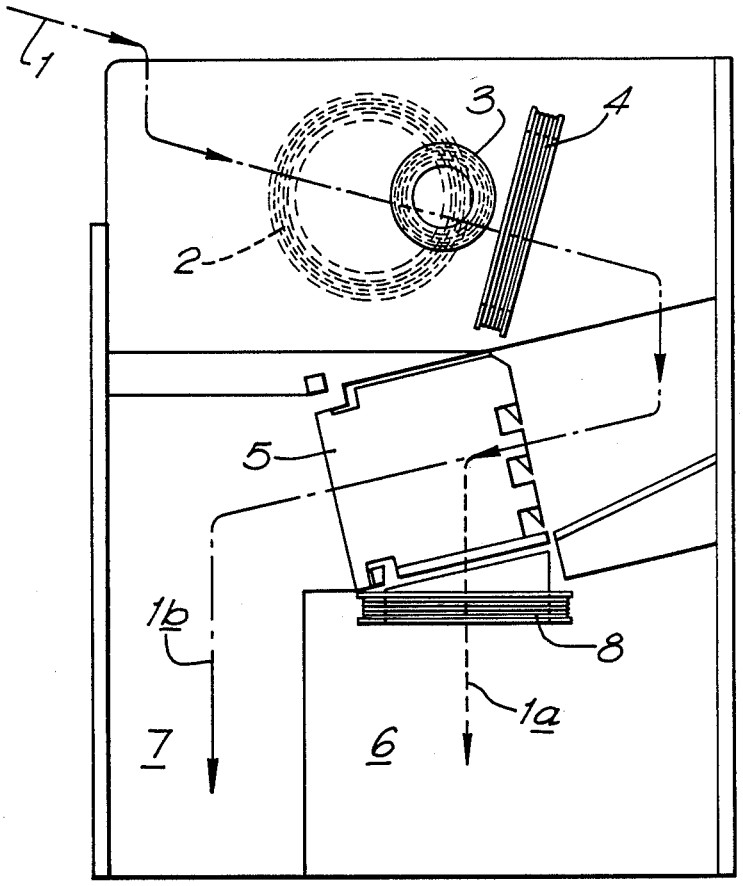
FIG. 1 is a schematic view of a multi-coin acceptor in accordance with the invention.

Provided in the accept chute 6 is a further coil 8 which is energised in such a manner as to detect the presence of acceptable coins. This provides a positive check to the circuitry of FIG. 2 that credit has been accumulated.

In accordance with the invention, the sensor coil arrangement 2, 3, 4 is selected to maximise discrimination between different coin denominations and counterfeit coins. The first coil 2 is disposed to one side of the coin passageway such that its axis extends orthogonally of the plane of the major face of the coins as they pass the coil. The diameter of the coil 2 is arranged to be generally but not always larger than the maximum diameter of coins that can pass down the passageway 1. The second coil, 3, is disposed to the opposite side of the coin passage way in the same orientation as coil 2, but mechanically offset above the floor (not shown) of the coin passageway such that only the upper parts of the coin under test occludes it, in comparison with coil 2 in which all the coin under test occludes the coil. The third coil 4 is arranged to wrap around the passageway such that the coil axis is parallel to the length of the passageway. The three coils are energised at different frequencies F1, F2, F3, where typically, F1 is 100 KHz, F2 equals 160 KHz and F3 is 100 KHz. This frequency arrangement permits an improved discrimination between coin denominations and counterfeit coins for the current British coin set and counterfeti coin (known as slugs). Of course other frequencies may be necessary for other coin sets and other uses of the device.

Figure 2:
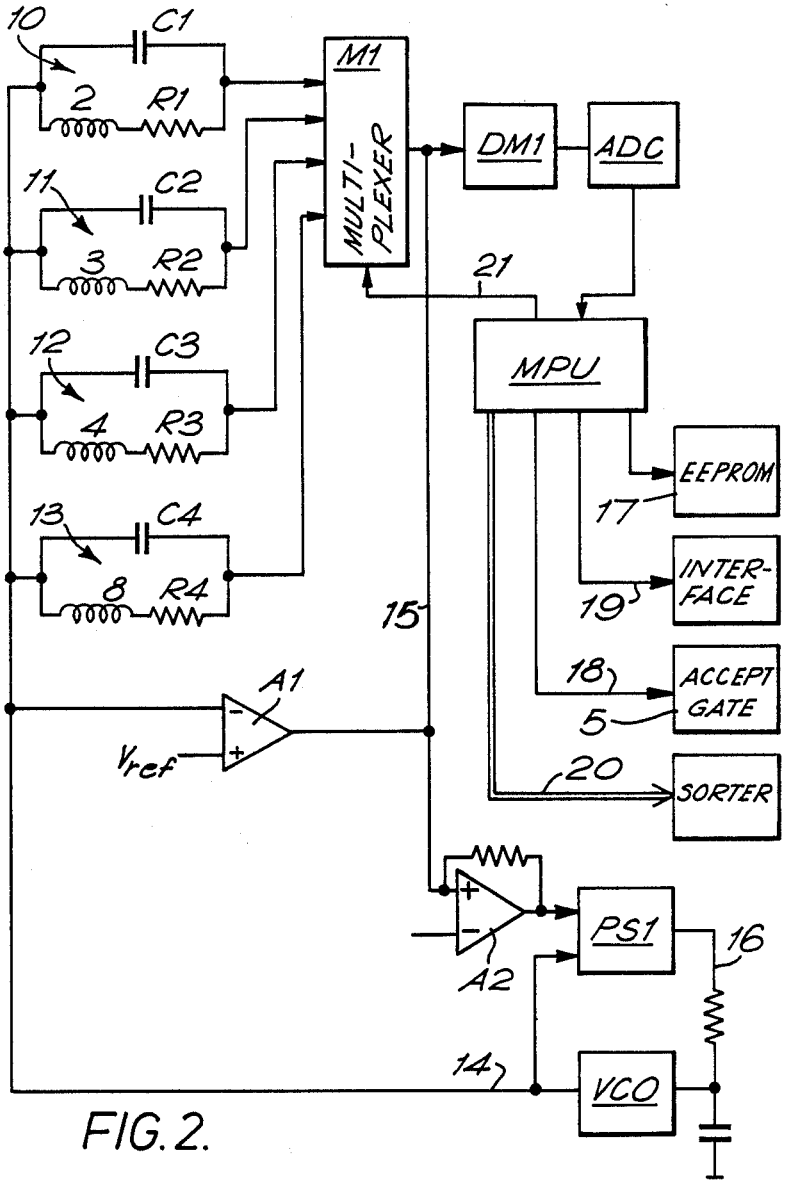
FIG. 2 is a schematic circuit diagram for discrimination circuitry connected to the sensor coils shown in FIG. 1.

As shown in FIG. 2, the coils 2, 3, 4, and 8 are each connected in a respective parallel resonant circuit 10 to 13 containing capacitors C1 to C4 and resistive temperature compensating components R1 to R4. Each of the resonant circuits 10 to 13 has its own natural resonant frequency when no coins are in proximity to the coils 2, 3, 4. Each of the resonant circuits 10 to 13 is driven sequentially via a phase locked loop at its own natural resonant frequency by mean sof a voltage controlled oscillator VCO which produces an oscillatory drive signal on line 14. The resonant circuits 10 to 13 are sequentially connected in a feed-back path to operational amplifier A1 via a multiplexer M1. The output of the multiplexer M1 on output line 15 is inverted by amplifier A2 and the resulting signal is compared in a phase comparator PS1 with the output of the voltage controlled oscillator VCO on line 14. The output of the phase comparator PS1 comprises a control voltage on line 16 which is used to control the frequency of the voltage controlled oscillator VCO. The phase locked loop maintains a 180° phase difference across the amplifier A1, which is the required condition to maintain the selected resonant circuit at its natural resonant frequency.

The multiplexer M1 is controlled by a microprocessor MPU to switch sequentially the resonant circuits 10 to 13 into the feed-back path of amplifier A1, so as to scan the sensor coils 2, 3, 4, 8 repetitively.

Figure 3:
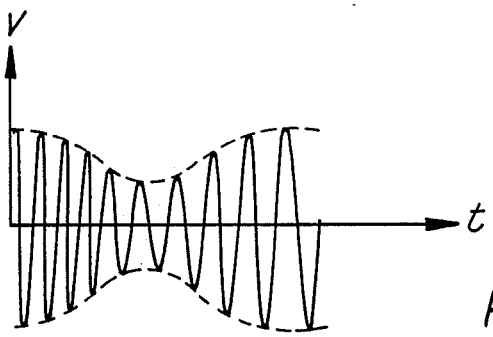
FIG. 3 is a graph showing how the frequency and amplitude of the oscillation produced on line 15 in FIG. 1 deviates with time.

Thus, in use, the absence of a coin, each of the resonant circuits 10 to 13 will produce sequentially on line 15 an output at a respective substantially constant frequency and amplitude, determined by the parameters of the resonant circuit concerned. However, considering the case for example of resonant circuit 10, when a coin rolls past the coil 2, an inductive coupling is formed between the coil 2 and the coin such that the impedance presented by the coil to the resonant circuit is modified. Consequently both the frequency and amplitude of the oscillation produced on line 15 deviates with time substantially as shown in FIG. 3. The change in impedance occurs by virtue of skin effect type eddy currents being induced by the coil in the coin. The magnitude of the frequency and amplitude deviations are dependent upon the relative sizes of the coil and the coin, the coin diameter and thickness, the metal from which the coin is made and the surface pattern embossed on the coin. Thus, as the coin passes the coil 2, there is transitory deviation of the natural resonant frequency for the resonant circuit 10. In accordance with the invention, the phase comparator PS1, the inverting amplifier A2 and voltage controlled oscillator VCO operate as a phase locked loop to maintain the drive frequency on line 14 at the resonant frequency for the circuit 10. As a result, the output from the resonant circuit on line 15, as the coin passes the coil 2, deviates mainly in accordance with the change in resistive component of the sensing coil impedance. This amplitude deviation is used as a parameter indicative of the size, metallic content and the embossed pattern of the coin.

The oscillatory signal on line 15 is demodulated by a demodulator DM1 and digitised by an analogue to digital converter circuit ADC. The analogue to digital converter operates repetitively so as to sample the signal on line 15 and store in microprocessor MPU signals indicative of the peak deviation of amplitude as the coin passes the coil 2.

The microprocessor MPU then switches the multiplexer M1 so that the process is repeated for the coils 3 and 4 sequentially as the coin passes the coils.

The resonant circuit 13 is utilised to ensure that the coin, if accepted, passes to the accept chute 6.

It has been found that for a coin of a particular denomination, a substantially unique set of amplitude deviations produced by the circuits 10, 11, 12, characterise the coin denomination. The device may thus be used as a multi-coin tester and sets of digital values which characterise these amplitude deviations for respective different coin denominations are stored in an EEPROM 17 to be compared by the microprocessor MPU with the values produced by the analogue to digital converter ADC for an actual coin under test. If the microprocessor determines the presence of an acceptable coin, it provides an output on line 18 to open the solenoid operated accept gate 5.

Also the microprocessor may produce on line or lines 19 an output indicative of acceptance of a coin of a particular denomination, for further data processing.

Further, an output may be provided on line 20 to operate a coin sorter for discriminating between coins of different denominations detected by the device.

The EEPROM 17 may be programmed in the factory with predetermined set of values representative of acceptable coins. Alternatively, the EEPROM may be programmed in the field by means of an additional external plug-in, microprocessor based unit (not shown) which connects to the data input of microprocessor MPU so as to override its normal operation and permit loading or modification of stored values in the EEPROM 17. The values to be stored for the EEPROM 17 may be produced by means of test coins to be fed through the coin passageway past the coils 2 to 4, which are sensed by the coils during an initial setting up operation.

We claim:

1. Coin discrimination apparatus comprising means defining a path for passage of coins under test; sensor coil means for forming an inductive coupling with coins under test during their passage along the path; a resonant circuit in which said sensor coil means is connected, said resonant circuit exhibiting a resonant frequency which varies in dependence upon the inductive coupling between the sensor coil means and the coin under test during the passage of the coin along the path; variable frequency oscillator means for energizing said resonant circuit; control means for varying the frequency of the oscillator means such that it tracks the varying resonant frequency of the oscillator means during passage of the coin along the path past the sensor coil means; and amplitude response means responsive to changes in amplitude of an oscillatory signal developed by the resonant circuit during said passage of the coin past the sensor coil means, whereby to provide a signal indicative of characteristics of the coin.

2. Apparatus according to claim 1 wherein the sensor coil means is connected in parallel with a capacitor in said resonant circuit, and said control means include a phase locked loop.

3. Apparatus according to claim 1 wherein said oscillator means comprises a voltage controlled oscillator, and said control means includes a phase comparator arranged to make a comparison of the phase of a signal from the resonant circuit with the phase of the output of the oscillator and to control the frequency of the oscillator in dependence upon said comparison.

4. Apparatus according to claim 1 including demodulator means for demodulating said oscillatory signal, and analogue to digital converter means for successively producing digitized sample value of the demodulated signal.

5. Apparatus according to claim 4 including microprocessor means responsive to said digitised sample value to determine the peak deviation of amplitude of the demodulated signal as a coin passes the sensor coil means.

6. Apparatus according to claim 5 wherein said microprocessor means is arranged to compare said peak deviation with a predetermined value thereof to provide signal indicative of acceptability or otherwise of the coin.

7. Apparatus according to claim 6 wherein the microprocessor means is arranged to compare said peak deviation with a plurality of predetermined values thereof to provide a signal indicative of coin denomination.

8. Apparatus according to claim 7 wherein said predetermined values are programmed into a programmable memory.

9. Apparatus according to claim 1 wherein said sensor coil means includes a plurality of sensor coils each connected in a respective said resonant circuit, and including multiplexer means for connecting said resonant circuit sequentially to said amplitude response means.

10. Apparatus according to claim 1 wherein said sensor coil means includes a plurality of sensor coils for forming an inductive coupling with coins travelling along the path, wherein a first of the coils is disposed to one side of the path, a second of the coils is disposed to another side of the path, and the third of the coils is so arranged that the path passes through the windings thereof.

11. Apparatus according to claim 10 wherein the diameter of the first coil is greater than that of the largest coin to be tested by the apparatus.

12. Coin discrimination apparatus comprising means defining a path for passage of a coin under test, sensor coil means for forming an inductive coupling with coins under test during their passage along the path, said sensor coil means being connected in a resonant circuit, oscillator means for energizing the resonant circuit, amplifier means having an input and an output, said resonant circuit being connected in a feedback loop between the input and output, control means for controlling the frequency of oscillation of the amplifier means such that the resonant circuit is maintained in resonance whilst a coin under test is inductively coupled thereto, said control means including means to tend to maintain a 180° phase difference between the input and output of the amplifier, and amplitude responsive means responsive to changes in amplitude of an oscillatory signal developed by the resonant circuit when the coin under test passes the sensor coil means and is inductively coupled thereto.

* * * * *

UNITED STATES PATENT AND TRADEMARK OFFICE

CERTIFICATE OF CORRECTION

PATENT NO. : 4,754,862

DATED : July 5, 1988

INVENTOR(S) : Adam Rawicz-Szczerbo & Les Hutton

It is certified that error appears in the above-identified patent and that said Letters Patent is hereby corrected as shown below:

Column 6, Claim 12, line 10, delete "amplifier" and substitute therefor --oscillator--.

Signed and Sealed this

Eighth Day of August, 1989

*Attest:*

*Attesting Officer*

DONALD J. QUIGG

*Commissioner of Patents and Trademarks*

UNITED STATES PATENT AND TRADEMARK OFFICE

CERTIFICATE OF CORRECTION

PATENT NO. : 4,754,862

DATED : July 5, 1988

INVENTOR(S) : Adam Rawicz-Szczerbo & Les Hutton

It is certified that error appears in the above-identified patent and that said Letters Patent is hereby corrected as shown below:

Column 5, Claim 1, line 13, delete "oscillator means" and substitute therefor--resonant circuit--;

Signed and Sealed this

Nineteenth Day of June, 1990

*Attest:*

HARRY F. MANBECK, JR.

*Attesting Officer*

*Commissioner of Patents and Trademarks*